US010960452B2

(12) United States Patent
Yuan et al.

(10) Patent No.: US 10,960,452 B2
(45) Date of Patent: Mar. 30, 2021

(54) METHOD FOR PRESSURE FORMING OF ALUMINUM ALLOY SPECIAL-SHAPED TUBULAR COMPONENT BY USING ULTRA LOW TEMPERATURE MEDIUM

(71) Applicant: DALIAN UNIVERSITY OF TECHNOLOGY, Dalian (CN)

(72) Inventors: Shijian Yuan, Dalian (CN); Xiaobo Fan, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 55 days.

(21) Appl. No.: 16/499,993

(22) PCT Filed: Dec. 10, 2018

(86) PCT No.: PCT/CN2018/120012
§ 371 (c)(1),
(2) Date: Oct. 1, 2019

(87) PCT Pub. No.: WO2020/103217
PCT Pub. Date: May 28, 2020

(65) Prior Publication Data

US 2020/0346271 A1 Nov. 5, 2020

(30) Foreign Application Priority Data

Nov. 19, 2018 (CN) ..... 201811377904.0

(51) Int. Cl.
*B21D 26/045* (2011.01)
*B21D 26/041* (2011.01)
(Continued)

(52) U.S. Cl.
CPC ..... *B21D 26/045* (2013.01); *B21D 26/033* (2013.01); *B21D 26/041* (2013.01);
(Continued)

(58) Field of Classification Search
CPC .. B21D 26/033; B21D 26/041; B21D 26/045; B21D 26/003; B21D 26/039;
(Continued)

(56) References Cited

U.S. PATENT DOCUMENTS 3,197,851 A * 8/1965 Aleck ..... B21D 51/24 228/157
4,846,900 A * 7/1989 Diehl ..... B21D 26/041 148/578
2004/0065394 A1* 4/2004 Ryu ..... B21D 26/033 148/695

FOREIGN PATENT DOCUMENTS

CN 1751819 A 3/2006
CN 106216481 A 12/2016
(Continued)

OTHER PUBLICATIONS

Itou, Translation of JPH08112626 (Year: 1996).*

*Primary Examiner* — Adam J Eiseman
*Assistant Examiner* — Bobby Y Kim
(74) *Attorney, Agent, or Firm* — Arent Fox LLP; Michael Fainberg

(57) ABSTRACT

The present invention discloses a method for pressure forming of an aluminum alloy special-shaped tubular component by using an ultra-low temperature medium. By means of the characteristics that the forming property of an aluminum alloy tube is greatly improved under ultra-low temperature conditions, a tube is cooled and pressurized in a die through an ultra-low temperature medium, so that the tube forms a special-shaped tubular component at an ultra-low temperature. In the method for pressure forming of an aluminum alloy special-shaped tubular component by using an ultra-low temperature medium, the ultra-low temperature medium is not only used for cooling the die and the tube, but also used for pressurization to achieve flexible loading of the
(Continued)

tube, which is favorable for forming complex special-shaped tubular components with varied cross-sections.

9 Claims, 5 Drawing Sheets

(51) Int. Cl.

| | |
|---|---|
| ***C22C 21/08*** | (2006.01) |
| ***C22C 21/10*** | (2006.01) |
| ***C22C 21/12*** | (2006.01) |
| ***B21D 26/033*** | (2011.01) |
| ***B21D 26/053*** | (2011.01) |

(52) U.S. Cl.
CPC ..... *B21D 26/053* (2013.01); *C22C 21/08* (2013.01); *C22C 21/10* (2013.01); *C22C 21/12* (2013.01)

(58) Field of Classification Search
CPC .... B21D 26/047; B21D 26/035; B21D 37/10; B21J 7/18; B30B 1/007; B30B 1/32
USPC ..... 72/54, 56, 60, 61; 29/421.1
See application file for complete search history.

(56) References Cited

FOREIGN PATENT DOCUMENTS

| | | | | | |
|---|---|---|---|---|---|
| CN | 107866491 | A | | 4/2018 | |
| CN | 107876617 | A | | 4/2018 | |
| CN | 108296340 | A | | 7/2018 | |
| DE | 3292920 | A1 | * | 3/2018 | ..... B21D 26/027 |
| EP | 1033188 | A1 | | 9/2000 | |
| JP | H08112626 | | * | 5/1996 | ..... B21D 22/22 |

* cited by examiner

METHOD FOR PRESSURE FORMING OF ALUMINUM ALLOY SPECIAL-SHAPED TUBULAR COMPONENT BY USING ULTRA LOW TEMPERATURE MEDIUM

CROSS-REFERENCE TO RELATED APPLICATIONS

This application is the U.S. National Stage Application of International Patent Application No. PCT/CN2018/120012, filed on Dec. 10, 2018, which claims priority to Chinese Patent Application No. 1201811377904.0, filed on Nov. 19, 2018, the contents of each of which is incorporated herein by reference in its entirety.

TECHNICAL FIELD

The present invention relates to the technical field of tube forming, and in particular to a method for pressure forming of an aluminum alloy special-shaped tubular component by using an ultra-low temperature medium.

BACKGROUND

As a lightweight material, aluminum alloy has high specific strength and good corrosion resistance and is widely used in the fields of aviation, aerospace and automobiles. With the further improvement of the requirements for high reliability, long service life and light weight of carrying devices such as new-generation launch vehicles, aircrafts and new energy vehicles, there is an increasing demand for the replacement of multiple split tailor-welded structures with overall structures. Examples are air intake ducts of aircrafts, chassis components of electric vehicles, and vehicle body frames. These components are complex special-shaped tubular components and each have a complex cross-section shape and large cross section difference and also have a local small fillet. These geometric features are coupled to difficulty in deformation of high-strength aluminum alloy, making these special-shaped tubular component have high forming difficulty.

At present, internal high-pressure forming (or hydroforming) is an advanced and mature technology for manufacturing hollow variable-cross-section special-shaped tubular components. The technology has been widely used in aerospace and automotive industries, and is suitable for materials with good room temperature plasticity, such as low carbon steel and stainless steel. For an aluminum alloy special-shaped tubular component with a simple shape, such as an automobile instrument panel bracket, internal high-pressure forming is also gradually being applied. However, a high-strength aluminum alloy having a tensile strength of more than 400 MPa is limited by problems such as low forming property and proneness to generation of range peel, the high-strength aluminum alloy needs to be formed by complex processes such as multi-pass preforming and intermediate annealing, and there are also problems of low yield and poor quality of finished products. For an integrated tube with a complex shape, when the cross section difference is large and the ratio of the fillet radius to the thickness is smaller than 3, the limit of high-pressure forming in the high-strength aluminum alloy is exceeded.

Since a large-diameter thin-walled seamless aluminum alloy tube blank cannot be obtained by an extrusion process, during the high-pressure forming of large-diameter aluminum alloy thin-walled integral tubular component, a prefabricated tube blank needs to be obtained by coiling welding of sheets. For example, the tube blank of a special-shaped air intake duct of an aircraft is more than 1 meter in diameter and the wall thickness is only a few millimeters, and a prefabricated tube blank needs to be obtained by sheet curling and friction stir welding. However, the strength and plasticity of a tailor-welded joint are usually lowered relative to those of a base metal, and the strength coefficient of a welding seam of a friction stir welding tube is smaller than 0.8, which is likely to cause cracking of a welding seam area during internal high-pressure forming, resulting in that the forming cannot be completed, and the application of large-diameter aluminum alloy special-shaped tubular components is limited.

The study found that the forming property of a high-strength aluminum alloy base metal and a friction stir welding seam under ultra-low temperature conditions is greatly improved, and the plasticity of the welding seam is similar to that of the base metal. For example, the forming property of 2219 aluminum alloy under 77K ultra-low temperature conditions is 70% higher than that of the 2219 aluminum alloy at room temperature. Under ultra-low temperature conditions, the forming properties of aluminum alloy and the welding seam are improved, which is beneficial to the forming of complex special-shaped tubular components.

SUMMARY

An objective of the present invention is to provide a method for pressure forming of an aluminum alloy special-shaped tubular component by using an ultra-low temperature medium, in order to solve the problems existing in the prior art, so that the forming property of a welding seam area of an aluminum alloy tube and a friction stir welding tube is greatly improved, which is favorable for the forming of a complex special-shaped variable-cross-sectional tubular component, achieving smooth forming of an aluminum alloy tubular component with a large cross section difference, and avoiding the cracking of a welding seam of a large-diameter aluminum alloy tubular component.

To achieve the above purpose, the present invention provides the following technical solution.

The present invention provides a method for pressure forming of an aluminum alloy special-shaped tubular components by using an ultra-low temperature medium, where by means of the characteristics that the forming property of an aluminum alloy tube is greatly improved under ultra-low temperature conditions, a tube is cooled and pressurized in a die through an ultra-low temperature medium, so that the tube forms a special-shaped tubular component at an ultra-low temperature, and the specific steps are as follows:

step 1: putting a tube into a die, closing the die, and blocking both ends of the tube with a left punch and a right punch to effectively seal the tube;

step 2: filling the tube with an ultra-low temperature medium, so that the tube is cooled to a set temperature lower than 123 K;

step 3: increasing the pressure of the ultra-low temperature medium in the tube, so that under the pressure of the ultra-low temperature medium, the tube abuts against the die for forming;

step 4: opening the die, withdrawing the left punch and the right punch, recovering the ultra-low temperature medium in the tube, and taking out a formed special-shaped tubular component.

Preferably, before the step 1 is implemented, the die is cooled to a set temperature lower than 123 K; the die includes an upper die and a lower die, the upper die and the lower die are each provided with a cyclic loop for circulation of the ultra-low temperature medium, and the die is cooled through the cyclic loop.

Preferably, the tube is first cooled to a set temperature lower than 123 K and then placed in the die.

Preferably, the set temperature of the tube and the die is in the range of 3-123 K.

Preferably, the right punch is provided with a channel communicated with the interior of the tube, the channel is communicated with a low temperature pressurizer, and the low temperature pressurizer injects an ultra-low temperature medium into the tube through the channel.

Preferably, in the step 2, the ultra-low temperature medium is simultaneously injected into the tube and a cavity of the die, so that the tube is cooled to a set temperature more uniformly and rapidly.

Preferably, the tube is an extruded tube or a tailor-welded tube, and the tube has a diameter of no more than 2000 mm and a wall thickness of 0.2-50 mm.

and axial feed, the tube abuts against the die for forming according to a given process curve, and the pressure is set to be no more than 200 MPa.

Preferably, the ultra-low temperature medium is liquid argon, liquid nitrogen or liquid helium.

Preferably, the tube is made of an Al—Cu alloy, an Al—Mg—Si alloy, an Al—Zn—Mg—Cu alloy or an Al—Li alloy.

Compared with the prior art, the present invention achieves the following technical effects:

In a method for pressure forming of an aluminum alloy special-shaped tubular component by using an ultra-low temperature medium, the ultra-low temperature medium is not only used for cooling a die and a tube, but also used for pressurization to achieve flexible loading of the tube under ultra-low temperature conditions, which is favorable for forming complex special-shaped tubular components with varied cross-sections. By means of the characteristics that the forming property of the aluminum alloy tube is greatly improved under ultra-low temperature conditions, the tube forms a complex special-shaped tubular component under ultra-low temperature conditions through cooling and pressurization by the ultra-low temperature medium. The tube deforms under ultra-low temperature conditions, and the forming property is greatly improved, solving the problem of cracking of the aluminum alloy special-shaped tubular component with a large cross section difference during hydroforming. The forming property of a welding seam of a friction stir welding tube and a base metal is greatly improved, and plasticity coefficients are similar, which solves the problem of cracking of a welding seam area of the large-diameter aluminum alloy special-shaped tubular component.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

In the figures, 1. upper die, 2. left punch, 3. lower die, 4. cyclic loop, 5. ultra-low temperature medium, 6. tube, 7. right punch, 8. low temperature pressurizer, 9. cryogenic container, 10. special-shaped tubular component, 11. cavity, 12. welding seam.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide a method for pressure forming of an aluminum alloy special-shaped tubular component by using an ultra-low temperature medium, in order to solve the problems existing in the prior art, so that the forming property of a welding seam area of an aluminum alloy tube and a friction stir welding tube is greatly improved, which is favorable for the forming of a complex special-shaped variable-cross-sectional tubular component, achieving smooth forming of an aluminum alloy tubular component with a large cross section difference, and avoiding the cracking of a welding seam of a large-diameter aluminum alloy tubular component.

To make the foregoing objective, features, and advantages of the present invention clearer and more comprehensible, the present invention is further described in detail below with reference to the accompanying drawings and specific embodiments.

Figure 1:
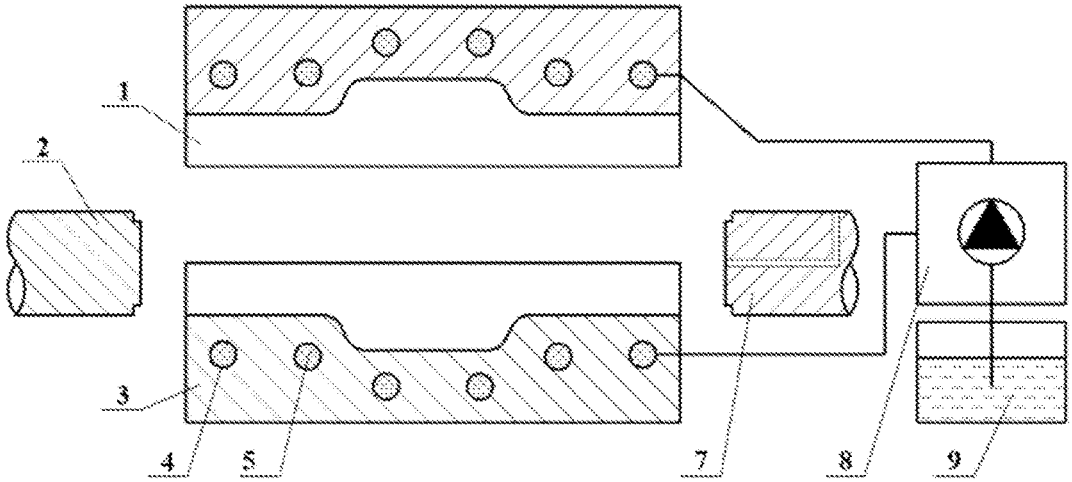
FIG. 1 is a schematic structural view 1 of a method for pressure forming of an aluminum alloy special-shaped tubular component by using an ultra-low temperature medium according to the present invention.
Figure 2:
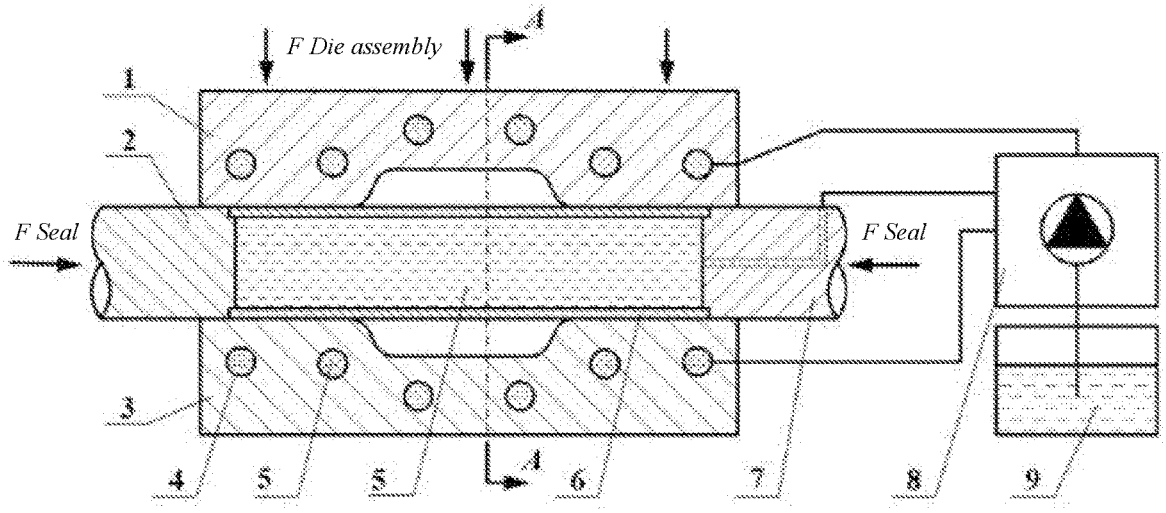
FIG. 2 is a schematic structural view 2 of a method for pressure forming of an aluminum alloy special-shaped tubular component by using an ultra-low temperature medium according to the present invention.
Figure 3:
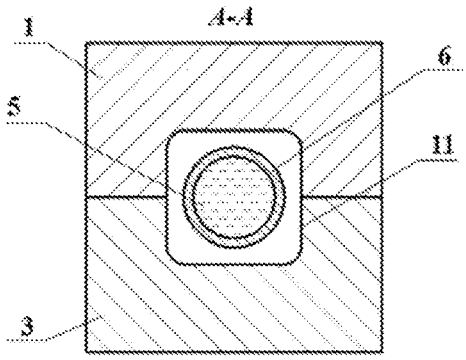
FIG. 3 is a schematic cross-sectional view of A-A in FIG. 2.
Figure 4:
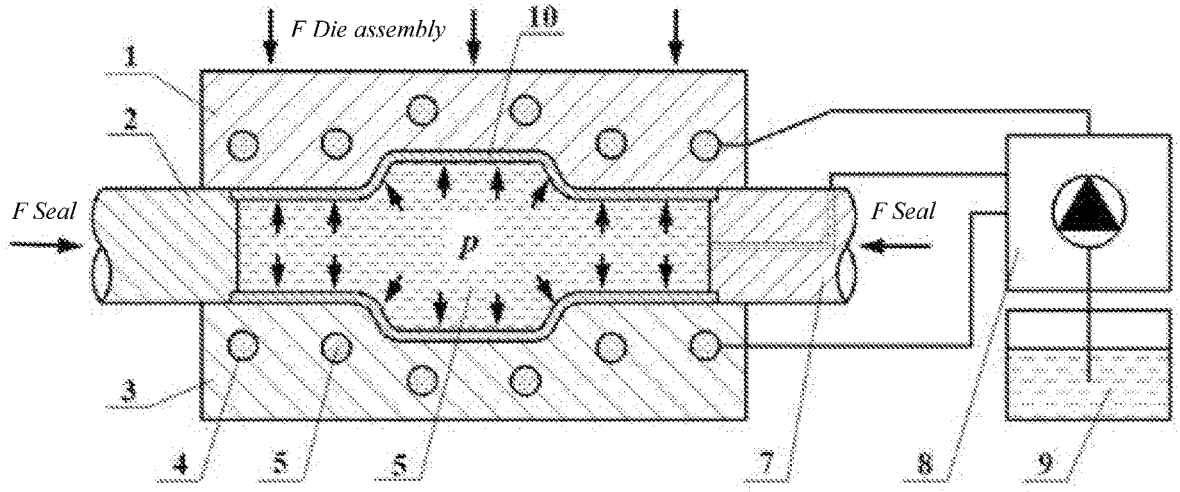
FIG. 4 is a schematic structural view 1 of contact molding of an aluminum alloy special-shaped tubular component in the present invention.
Figure 5:
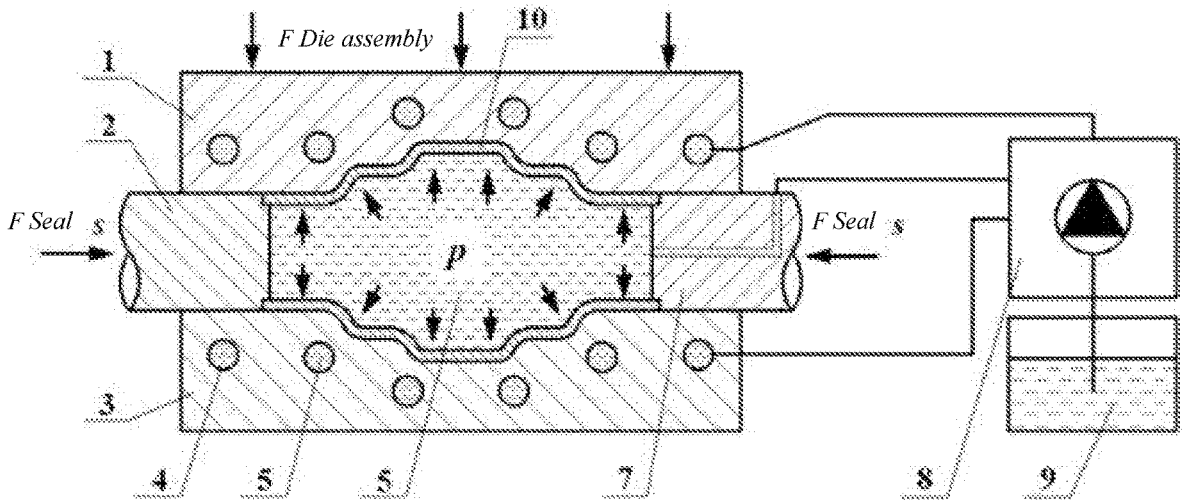
FIG. 5 is a schematic structural view 2 of contact molding of an aluminum alloy special-shaped tubular component in the present invention.
Figure 6:
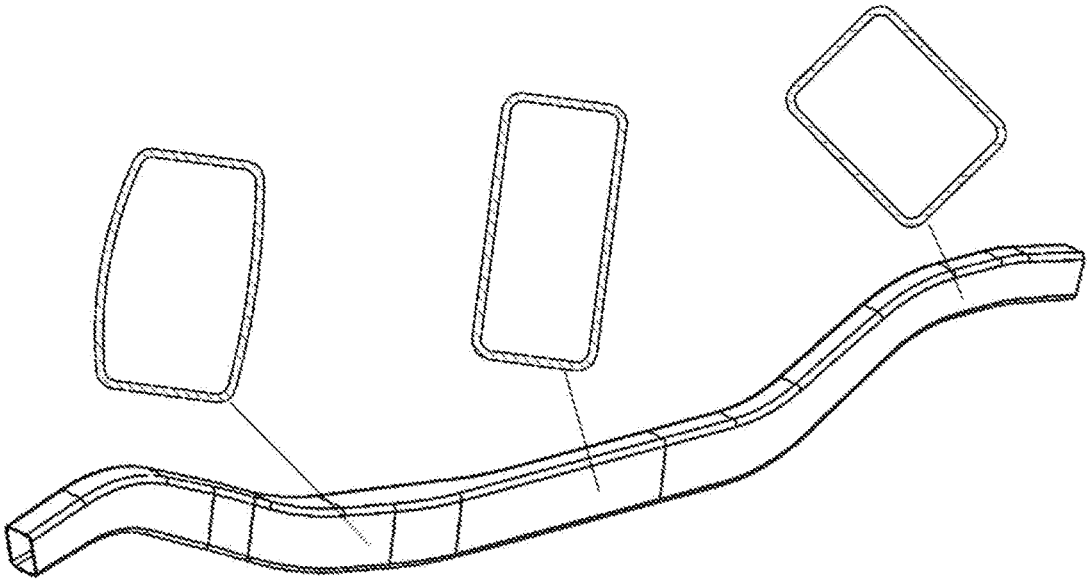
FIG. 6 is a schematic structural view of a formed special-shaped tubular component in the present invention.
Figure 7:
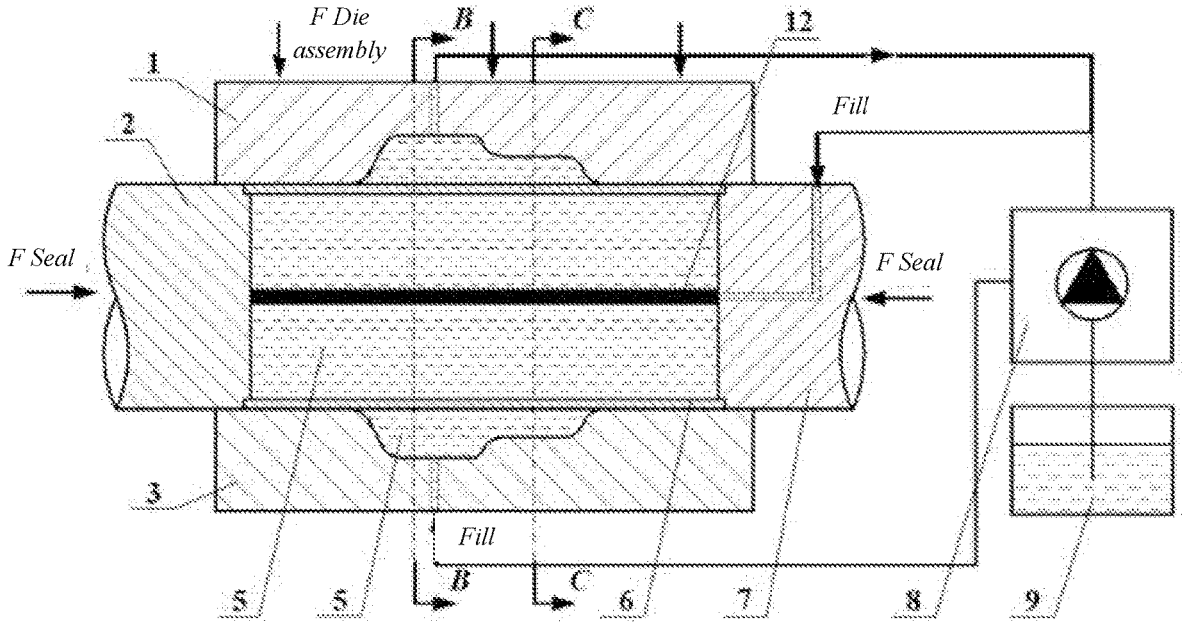
FIG. 7 is a schematic structural view 1 of a method for pressure forming of an aluminum alloy special-shaped tubular component by using an ultra-low temperature medium according to Embodiment 4 of the present invention.
Figure 8:
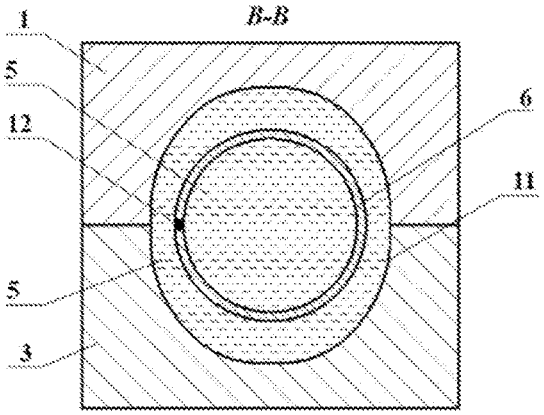
FIG. 8 is a schematic cross-sectional view of B-B in FIG. 7.
Figure 9:
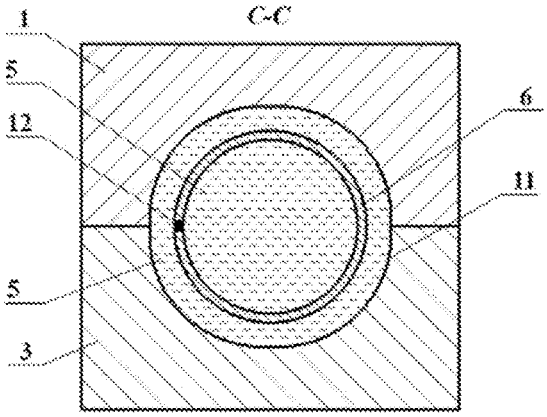
FIG. 9 is a schematic cross-sectional view of C-C in FIG. 7.
Figure 10:
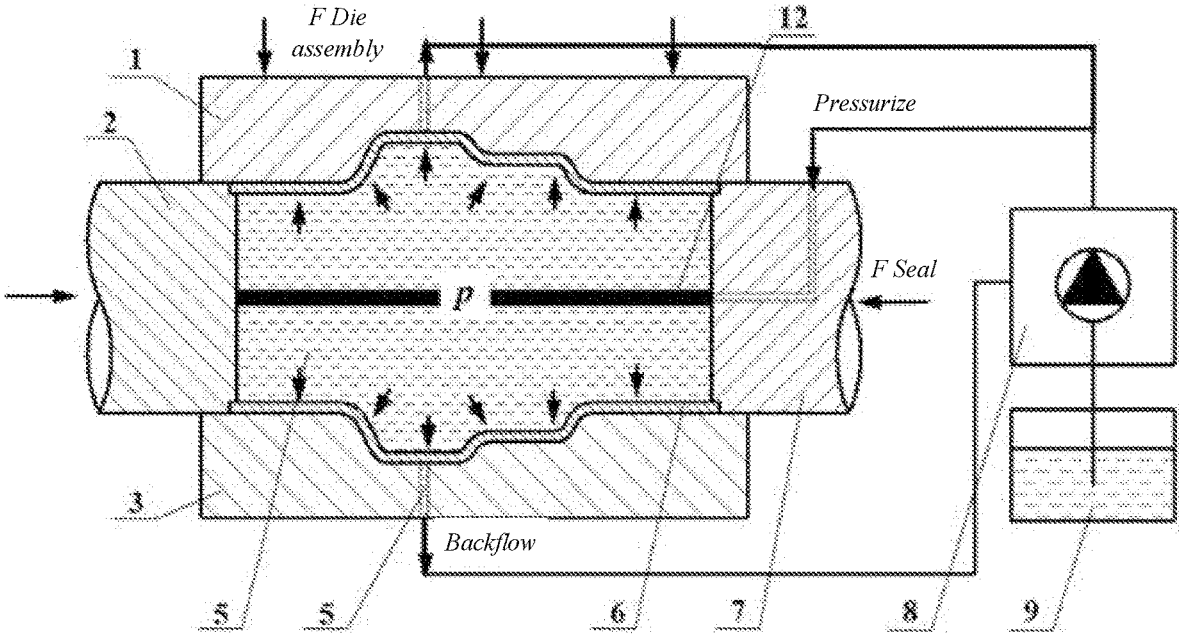
FIG. 10 is a schematic structural view 2 of a method for pressure forming of an aluminum alloy special-shaped tubular component by using an ultra-low temperature medium according to Embodiment 4 of the present invention.
Figure 11:
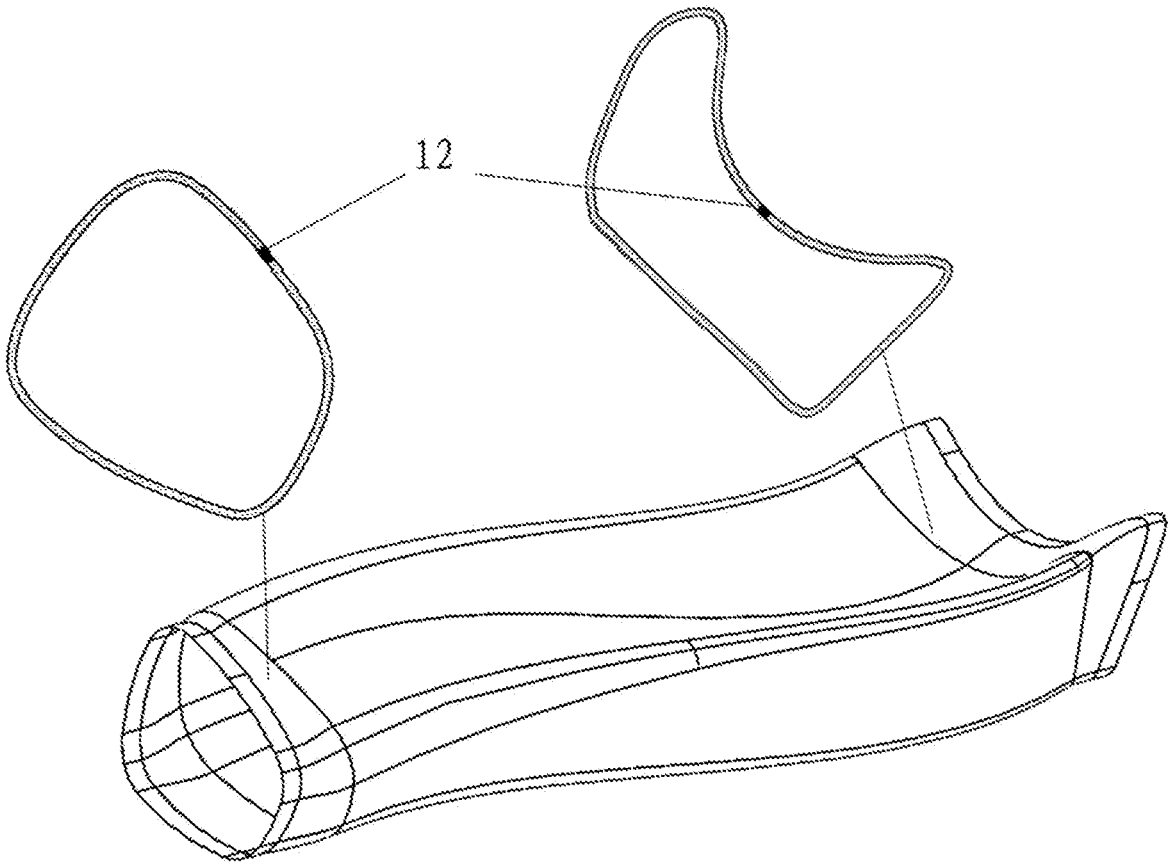
FIG. 11 is a schematic structural view of a formed special-shaped tubular component in Embodiment 4 the present invention.

As shown in FIG. 1 to FIG. 11, the present embodiment provides a method for pressure forming of an aluminum alloy special-shaped tubular component by using an ultra-low temperature medium. By means of the characteristics that the forming property of an aluminum alloy tube is greatly improved under ultra-low temperature conditions, a tube 6 is cooled and pressurized in a die through an ultra-low temperature medium 5, so that the tube 6 forms a special-shaped tubular component 10 at an ultra-low temperature, the tube 6 is an extruded tube or a tailor-welded tube, and the tube 6 has a diameter of no more than 2000 mm and a wall thickness of 0.2-50 mm; and the ultra-low temperature medium 5 is liquid argon, liquid nitrogen or liquid helium. The tube 6 is made of an aluminum alloy material, and the material is preferably an Al—Cu alloy, an Al—Mg—Si alloy, an Al—Zn—Mg—Cu alloy or an Al—Li alloy.

Specific Steps are as Follows:

Step 1: put a tube 6 into a die, close the die, and block both ends of the tube 6 with a left punch 2 and a right punch 7, to effectively seal the tube 6; where the right punch is provided with a channel communicated with the interior of the tube 6, the channel is communicated with a low temperature pressurizer 8, and the low temperature pressurizer 8 injects an ultra-low temperature medium 5 into the tube 6 through the channel. Before the step 1 is implemented, the die can be cooled to a set temperature lower than 123 K. The die includes an upper die and a lower die, the upper die 1 and the lower die 3 are each provided with a cyclic loop 4 for circulation of the ultra-low temperature medium 5, and the die is cooled through the cyclic loop 4. The set temperature of the tube 6 and the die is in the range of 3-123 K. It is also possible to first cool the tube 6 to a set temperature lower than 123 K, and then place the tube into the die, and cool the die and the tube 6 together.

Step 2: fill the tube 6 with the ultra-low temperature medium 5, so that the tube 6 is cooled to a set temperature lower than 123 K. Preferably, in the step 2, the ultra-low temperature medium 5 is simultaneously injected into the tube 6 and a cavity 11 of the die, so that the tube 6 is cooled to a set temperature more uniformly and rapidly.

Step 3: increase the pressure of the ultra-low temperature medium 5 in the tube 6 through the low temperature pressurizer 8, so that under the pressure of the ultra-low temperature medium 5, the tube 6 abuts against the die for forming. Preferably, in the step 3, under the action of a pressure of the ultra-low temperature medium 5 and axial feed, the tube 6 abuts against the die for forming according to a given process curve, and the pressure is set to be no more than 200 MPa.

Step 4: open the die, withdraw the left punch 2 and the right punch 7, recover the ultra-low temperature medium 5 in the tube 6 into a cryogenic container 9, and take out a formed special-shaped tubular component 10.

The cross section of the cavity 11 in this embodiment may also be one or a combination of more of a circular cross section, a square cross section or other cross sections, to achieve the filling of the circular cross section, the square cross section or special-shaped cross sections.

In this embodiment, the aluminum alloy tube 6 is cooled to an ultra-low temperature by the ultra-low temperature medium 5, so that the tube 6 deforms under ultra-low temperature conditions, and the forming property is greatly improved, solving the problem of cracking of a complex aluminum alloy special-shaped tubular component during hydraulic forming; and the method for pressure forming by using the ultra-low temperature medium 5 greatly improves the forming property of a friction stir welding tube base metal and a welding seam 12 and makes plasticity coefficients similar, solving the problem of cracking of the welding seam 12 area of a large-size aluminum alloy special-shaped tubular component. The naturally-placed tube 6 is placed in a cold state die, so that a frozen lubricating layer is formed on the surface of the tube 6, the flowing frictional resistance of the tube 6 is reduced, the axial feeding is realized, and the wall thickness uniformity is improved. The ultra-low temperature medium 5 is not only used for cooling the die and the tube 6, but also used for pressurization to achieve flexible loading of the tube 6 under ultra-low temperature conditions, which is favorable for forming complex special-shaped tubular components with varied cross-sections. The ultra-low temperature medium 5 is simultaneously introduced into the interior and exterior of the tube 6 to only cool the tube 6, which not only easily achieves the more uniform and rapid cooling of a tailor-welded tube base metal and the welding seam 12 to an ultra-low temperature, but also solves the problem of difficulty in cooling a large-size die.

Embodiment 1

As shown in FIG. 1 to FIG. 6, the tube 6 in this embodiment is a solid solution state 6061 aluminum alloy tube having a thickness of 4.5 mm and a diameter of 140 mm; the cross section of each of cavities 11 of the upper die 1 and the lower die 3 is a special-shaped cross section, the equivalent outer diameter maximum is 190 mm, and the corresponding tube 6 has a cross section difference of 35.7%. Specific steps are as follows:

Step 1: use liquid nitrogen as an ultra-low temperature medium 5 to simultaneously cool the upper die 1, the lower die 3, the left punch 2 and the right punch 7 to a temperature lower than 123 K; where the upper die 1 and the lower die 3 are each provided with a cyclic loop 4 for circulation of the ultra-low temperature medium 5, and the die is cooled through the cyclic loop 4.

Step 2: place the decontaminated room temperature tube 6 in the die, close the upper die 1 and the lower die 3, and simultaneously advance the left punch 2 and the right punch 7 to block the tube 6.

Step 3: fill the tube with the ultra-low temperature medium 5 through the low temperature pressurizer 8, so that the tube 6 is cooled to a temperature lower than 123 K under the combined action of the ultra-low temperature medium 5 and the cold state die.

Step 4: pressurize the ultra-low temperature medium 5 inside the tube 6 through the low temperature pressurizer 8, and apply a unit pressure of 100 MPa, so that the tube 6 is subjected to bulging deformation under the pressure of the ultra-low temperature medium 5 and gradually abuts against the die for completion of forming.

Step 5: remove pressure inside the tube 6, draw back the left punch 2 and the right punch 7, recover the ultra-low temperature medium 5 into the cryogenic container 9, and open the die and take out a tubular component to complete the pressure forming of the special-shaped tubular component 10 by using the ultra-low temperature medium. Then the special-shaped tubular component 10 is subjected to artificial aging treatment.

The cross section of the cavity 11 in this embodiment may also be one or a combination of more of a circular cross section, a square cross section or other cross sections, to achieve the filling of the circular cross section, the square cross section or special-shaped cross sections. In this embodiment, liquid nitrogen can be replaced by liquid argon or liquid helium.

The ultra-low temperature medium 5 in this embodiment is not only used for cooling a die and the tube 6, but also used for pressurization to achieve flexible loading of the tube 6 under ultra-low temperature conditions, which is favorable for forming complex special-shaped tubular components with varied cross-sections. The aluminum alloy tube 6 is cooled to an ultra-low temperature through the ultra-low temperature medium 5, the tube 6 deforms under ultra-low temperature conditions, and the forming property is greatly improved, solving the problem of cracking of the aluminum alloy special-shaped tubular component with a large cross section difference during hydraulic forming.

Embodiment 2

As shown in FIG. 1 to FIG. 6, the tube 6 in this embodiment is a T4 state 2024 aluminum alloy tube having a thickness of 2.0 mm and a diameter of 60 mm; the cross section of each of cavities 11 of the upper die 1 and the lower die 3 is a special-shaped cross section, the local small fillet radius is 4.0 mm, the equivalent outer diameter maximum is 92 mm, and the corresponding cross section difference is 53.3%. Specific steps are as follows:

Step 1: use liquid nitrogen as an ultra-low temperature medium 5 to simultaneously cool the upper die 1, the lower die 3, the left punch 2 and the right punch 7 to a temperature lower than 123 K; where the upper die 1 and the lower die 3 are each provided with a cyclic loop 4 for circulation of the ultra-low temperature medium 5, and the die is cooled through the cyclic loop 4.

Step 2: place the decontaminated room temperature tube 6 in the die, close the upper die 1 and the lower die 3, and simultaneously advance the left punch 2 and the right punch 7 to block the tube 6.

Step 3: fill the tube 6 with the ultra-low temperature medium 5 through the low temperature pressurizer 8, so that the tube 6 is cooled to a temperature lower than 123 K under the combined action of the ultra-low temperature medium 5 and the cold state die.

Step 4: pressurize the ultra-low temperature medium 5 inside the tube 6 through the low temperature pressurizer 8, apply a unit pressure of 120 MPa, so that under the combined action of a pressure of the ultra-low temperature medium 5 and axial feed of the punch, the tube 6 abuts against the die until the forming is completed.

Step 5: remove pressure inside the tube 6, draw back the left punch 2 and the right punch 7, open the die to take out a tubular component, recover the ultra-low temperature medium 5 into a cryogenic container 9 to complete the pressure forming of the special-shaped tubular component 10 by using the ultra-low temperature medium.

The ultra-low temperature medium 5 in this embodiment is not only used for cooling a die and the tube 6, but also used for pressurization to achieve flexible loading of the tube 6 under ultra-low temperature conditions, which is favorable for forming complex special-shaped tubular components with varied cross-sections. The aluminum alloy tube 6 is cooled to an ultra-low temperature through the ultra-low temperature medium 5, the tube 6 deforms under ultra-low temperature conditions, and the forming property is remarkably improved, solving the problem of cracking of the aluminum alloy special-shaped tubular component with a large cross section difference during hydraulic forming. Under the combined action of a pressure of the ultra-low temperature medium 5 and axial feed of the punch, the tube 6 gradually abuts against the die for forming, which is favorable for achieving the forming of the special-shaped tubular component 10 with a greater cross section difference (>50%). The naturally-placed tube 6 is placed in the cold state die, so that a frozen lubricating layer is formed on the surface of the tube 6, the flowing frictional resistance of the tube 6 is reduced, the axial feeding is realized more easily, and the wall thickness uniformity is improved.

Embodiment 3

As shown in FIG. 1 to FIG. 6, the tube 6 in this embodiment is an annealed 7075 aluminum alloy tube having a thickness of 1.0 mm and a diameter of 60 mm; the cross section of each of cavities 11 of the upper die 1 and the lower die 3 is a special-shaped cross section, the local small fillet radius is 2.0 mm, the equivalent outer diameter maximum is 80 mm, and the corresponding cross section difference is 33.3%. The difference from Embodiment 1 is that the die of this embodiment is not cooled and only the aluminum alloy tube 6 is cooled to a temperature lower than 123 K. Specific steps are as follows:

Step 1: place the decontaminated tube 6 in the die, close the upper die 1 and the lower die 3, and simultaneously advance the left punch 2 and the right punch 7 to block the tube 6.

Step 2: quickly fill the tube 6 with the ultra-low temperature medium 5 through the low temperature pressurizer 8, so that the tube 6 is cooled to a temperature lower than 123 K under the action of the circulating ultra-low temperature medium 5.

Step 3: pressurize the ultra-low temperature medium 5 inside the tube 6 through the low temperature pressurizer 8, apply a unit pressure of 100 MPa, so that the tube 6 is subjected to bulging deformation under the pressure of the ultra-low temperature medium 5 until the tube 6 completely abuts against the die.

Step 4: remove pressure inside the tube 6, recover the ultra-low temperature medium 5 into the cryogenic container 9, draw back the left punch 2 and the right punch 7, and open the die to take out the tubular component, thereby completing the pressure forming of the aluminum alloy special-shaped tubular component by using the ultra-low temperature medium.

The tube 6 of this embodiment has a small wall thickness, the ultra-low temperature medium 5 only quickly cools the tube 6 and does not cool the die, which can not only achieve flexible loading under ultra-low temperature conditions, but also achieve efficient forming of complex special-shaped tubular components with varied cross-sections. The tube 6 deforms under ultra-low temperature conditions, and the forming property is greatly improved, solving the problem of cracking of the aluminum alloy special-shaped tubular component with a large cross section difference during hydraulic forming. Through the ultra-low temperature medium 5, the thin-walled aluminum alloy tube can be directly cooled to an ultra-low temperature lower than 123 K and the die may not be cooled, which is favorable for improving the forming efficiency of the thin-walled special-shaped cross-section tubular component.

Embodiment 4

As shown in FIG. 7 to FIG. 11, the tube 6 in this embodiment is a solid solution state 2195 aluminum lithium alloy friction stir welding tailor-welded tube having a thickness of 4.0 mm and a diameter of 600 mm; the cross section of each of cavities 11 of the upper die 1 and the lower die 3 is a special-shaped cross section, the equivalent outer diameter maximum is 760 mm, and the corresponding cross section difference is 26.7%. Specific steps are as follows:

Step 1: place the decontaminated tube 6 in the die, close the upper die 1 and the lower die 3, and simultaneously advance the left punch 2 and the right punch 7 to block and seal the tube 6.

Step 2: quickly fill the tube 6 and the cavity 11 of the die with the ultra-low temperature medium 5 simultaneously through the low temperature pressurizer 8, so that the friction stir welding tube is cooled to a temperature lower than 123 K under the action of the ultra-low temperature medium 5 at the inner side and the outer side.

Step 3: pressurize the ultra-low temperature medium 5 inside the tube 6 through the low temperature pressurizer 8, apply a unit pressure of 80 MPa, so that the tube 6 is subjected to bulging under the pressure of the ultra-low temperature medium 5 until the tube 6 gradually abuts against the die for completion of the forming.

Step 4: remove pressure inside the tube 6, recover the ultra-low temperature medium 5 into the cryogenic container 9, draw back the left punch 2 and the right punch 7, and open the die to take out the tubular component, thereby completing the pressure forming of the aluminum alloy special-shaped tubular component by using the ultra-low temperature medium 5. Then the special-shaped tubular component 10 can be subjected to artificial aging treatment to improve part strength.

The ultra-low temperature medium 5 in this embodiment is not only used for cooling the tube 6, but also used for pressurization to achieve flexible loading of the tube 6 under ultra-low temperature conditions, which is favorable for forming complex special-shaped tubular components with varied cross-sections. The ultra-low temperature medium 5 is introduced into the interior and exterior of the tube 6, which not only easily achieves the more uniform and rapid cooling of a tailor-welded tube base metal and the welding seam 12 to an ultra-low temperature, but also solves the problem of difficulty in cooling a large-size die. The tube 6 deforms under ultra-low temperature conditions, the forming property of the base metal of the friction stir welding tube and the welding seam 12 is greatly improved, and plasticity coefficients are similar, which solves the problem of cracking of the welding seam 12 area of the aluminum alloy special-shaped tubular component.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the present invention.

What is claimed is:

1. A method for pressure forming of an aluminum alloy special-shaped tubular component by using an ultra-low temperature medium, the steps comprising:

step 1: a die is cooled to a set temperature lower than 123 K; the die comprises an upper die and a lower die, the upper die and the lower die are each provided with a cyclic loop for circulation of the ultra-low temperature medium, and the die is cooled through the cyclic loop;

step 2: the tube is first cooled to a set temperature lower than 123 K and then placed in the die;

step 3: putting the tube into the die, closing the die, and blocking both ends of the tube with a left punch and a right punch to effectively seal the tube;

step 4: filling the tube with an ultra-low temperature medium, so that the tube is maintained at a set temperature lower than 123 K;

step 5: increasing the pressure of the ultra-low temperature medium in the tube, so that under the pressure of the ultra-low temperature medium, the tube abuts against the die for forming; and step 6: opening the die, withdrawing the left punch and the right punch, and taking out a formed special-shaped tubular component.

2. The method for pressure forming of an aluminum alloy special-shaped tubular component by using an ultra-low temperature medium according to claim 1, wherein the set temperature of the tube and the die is in the range of 3-123 K.

3. The method for pressure forming of an aluminum alloy special-shaped tubular component by using the ultra-low temperature medium according to claim 1, wherein the right punch is provided with a channel communicated with the interior of the tube, the channel is communicated with a low temperature pressurizer, and the low temperature pressurizer injects an ultra-low temperature medium into the tube through the channel.

4. The method for pressure forming of an aluminum alloy special-shaped tubular component by using an ultra-low temperature medium according to claim 3, wherein in the step 2, the ultra-low temperature medium is simultaneously injected into the tube and a cavity of the die, so that the tube is cooled to the set temperature more uniformly and rapidly.

5. The method for pressure forming of an aluminum alloy special-shaped tubular component by using an ultra-low temperature medium according to claim 1, wherein the tube is an extruded tube or a tailor-welded tube, and the tube has a diameter of no more than 2000 mm and a wall thickness of 0.2-50 mm.

6. The method for pressure forming of an aluminum alloy special-shaped tubular component by using an ultra-low temperature medium according to claim 1, wherein in the step 3, under the action of a pressure of the ultra-low temperature medium and axial feed, the tube abuts against the die for forming according to a given process curve, and the pressure is set to be no more than 200 MPa.

7. The method for pressure forming of an aluminum alloy special-shaped tubular component by using an ultra-low temperature medium according to claim 1, wherein the ultra-low temperature medium is liquid argon, liquid nitrogen or liquid helium.

8. The method for pressure forming of an aluminum alloy special-shaped tubular component by using an ultra-low temperature medium according to claim 1, wherein the tube is made of an Al—Cu alloy, an Al—Mg—Si alloy, an Al—Zn—Mg—Cu alloy or an Al—Li alloy.

9. The method for pressure forming of an aluminum alloy special-shaped tubular component by using an ultra-low temperature medium according to claim 1, wherein the set temperature of the tube and the die is in the range of 3-123 K.

* * * * *